US006253687B1

(12) United States Patent
McAllister

(10) Patent No.: US 6,253,687 B1
(45) Date of Patent: Jul. 3, 2001

(54) ADJUSTABLE SHELVING ASSEMBLY

(75) Inventor: Larry N. McAllister, Dover, DE (US)

(73) Assignee: Metal Masters Food Service Equipment Co., Clayton, DE (US)

( * ) Notice: Subject to any disclaimer, the term of this patent is extended or adjusted under 35 U.S.C. 154(b) by 0 days.

(21) Appl. No.: 09/063,446

(22) Filed: Apr. 21, 1998

(51) Int. Cl.[7] ..... A47B 9/00
(52) U.S. Cl. ..... 108/107; 108/192; 108/147.3
(58) Field of Search ..... 108/147.13, 147.14, 108/147.15, 147.17, 147.11, 180, 192, 193, 106, 107

(56) References Cited

U.S. PATENT DOCUMENTS 4,079,678 * 3/1978 Champagne ..... 108/147.12 X
4,230,052 10/1980 Champagne .
4,421,239 12/1983 Vargo .
4,592,286 6/1986 Trubiano .
4,615,278 10/1986 Cabrelli .
4,627,543 * 12/1986 Nicely ..... 108/192 X
4,637,323 * 1/1987 Nicely ..... 108/192 X
4,656,952 * 4/1987 Schweizer ..... 108/147.13 X
4,706,576 * 11/1987 James ..... 108/192
4,750,626 * 6/1988 Nicely ..... 108/192 X
4,811,670 * 3/1989 Kolvites et al. ..... 108/192 X
5,174,200 * 12/1992 Jeandel et al. ..... 108/193 X
5,531,167 * 7/1996 Stevens et al. ..... 108/147.13 X

* cited by examiner

*Primary Examiner*—Jose V. Chen
(74) *Attorney, Agent, or Firm*—Connolly Bove Lodge and Hutz LLP

(57) ABSTRACT

Shelf retaining collars function to releasably attach shelving to a plurality of vertical support posts. Each collar has an open front face for placement of the collars around the support posts. Also, each shelf retaining collar has a frusto-conical interior surface, and a pair of upwardly extending shelf supporting hooks that extend outwardly from the open front face. When the shelf retaining collars are attached to the support posts the hooks engage and support the shelving. Such shelving may be mounted horizontally or angularly, if desired.

2 Claims, 3 Drawing Sheets

10
24
26
22
24
28
16
12
20
12
18
14
18
18
14
18
26
28

ADJUSTABLE SHELVING ASSEMBLY

BACKGROUND OF THE INVENTION

The present invention relates to an adjustable shelving assembly, and more particularly to an assembly that includes horizontally and/or angularly mounted shelving without the need for dismantling the overall assembly when additional shelving is desired.

Prior to the present invention numerous adjustable shelving systems have been proposed. In many of these systems adjustment of the shelving by adding or removing individual shelves thereof required total dismantling and reconstruction of the shelving. This disadvantage is the result of unitary corner collars on the shelving. A relatively simple and economical procedure has long been sought for the removal and/or addition of shelving without the need for total dismantling the shelving assembly.

Reference is made to application Ser. No. 08/923,441, filed Sep. 4, 1997, the contents of which are incorporated herein by reference.

SUMMARY OF THE INVENTION

Accordingly, the present invention provides for the addition and/or removal of particular shelving from a shelving assembly without dismantling the assembly.

Another object of the present invention is to provide an adjustable shelving assembly with shelf retaining collars that function to secure the shelving to a plurality of vertical support posts.

Still another object of the present invention is an overall adjustable shelving assembly which is user friendly and which enables shelving to be horizontally and/or angularly mounted.

In accordance with the present invention, a shelf retaining collar is used to releasably attach shelving to a plurality of vertical support posts. Each collar has an open front face for placement of the collars around the support posts. Each collar has a frusto-conical interior surface which is complementary to the exterior frusto-conical surface of a split sleeve releasably attached to one of the vertical support posts. The mating of these frusto-conical surfaces secures the shelf retaining collar to the split sleeve. Moreover, since the split sleeve is releasably mounted to one of the vertical support posts, the collar is thereby releasably secured to that post via the split sleeve. Upwardly extending self supporting hooks outwardly extend from the open face of each shelf retaining collar. These hooks engage and support the shelving added to the assembly.

Preferably, the shelving has a generally square recess in each corner, and a corner shelf clip is secured to the shelf at the corners. Vertical slots on the shelf clips engage the hooks on the shelf retaining collar to secure the shelving to the collars and in turn to the posts. As connected, the shelving is free to articulate about a horizontal axis which enables horizontal or inclined positioning of the shelving relative to the vertical posts.

Each shelf retaining collar is utilized with a vertical support post, and an interlocking split sleeve is positioned between the collar and the post. The split sleeve has an interior surface releasably connected to the support posts and an external frusto-conical surface complementary to the interior frusto-conical surface of the collar.

BRIEF DESCRIPTION OF THE DRAWINGS

Novel features and advantages of the present invention in addition to those discussed above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
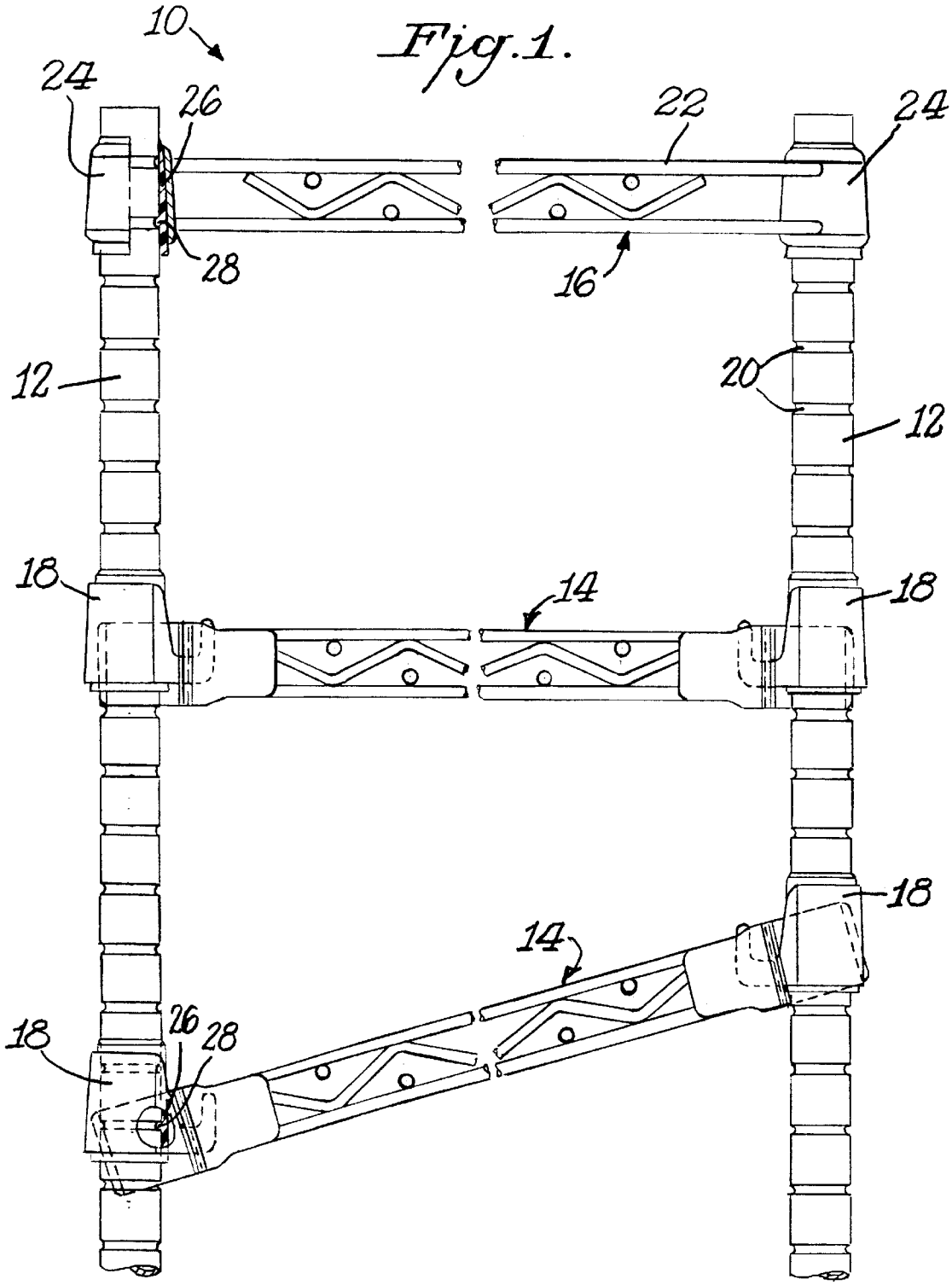
FIG. 1 is a side elevational view of an adjustable shelving assembly including horizontaly and angularly mounted shelves, according to the present invention.
Figure 2:
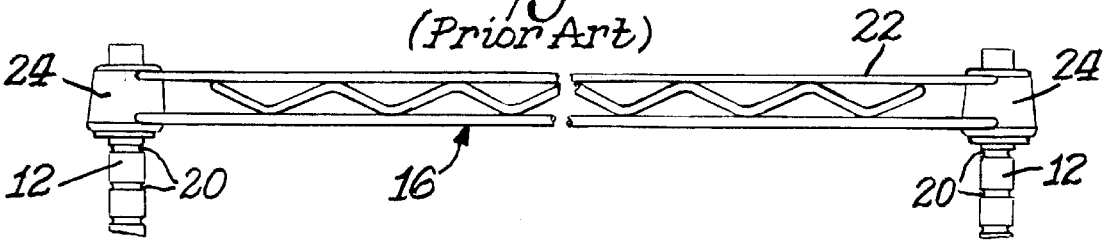
Fig. 2. (Prior Art)
FIG. 2 is a side elevational view illustrating horizontally disposed adjustable shelving and corner posts according to the prior art, with portions thereof broken away to illustrate interior details.
Figure 3:
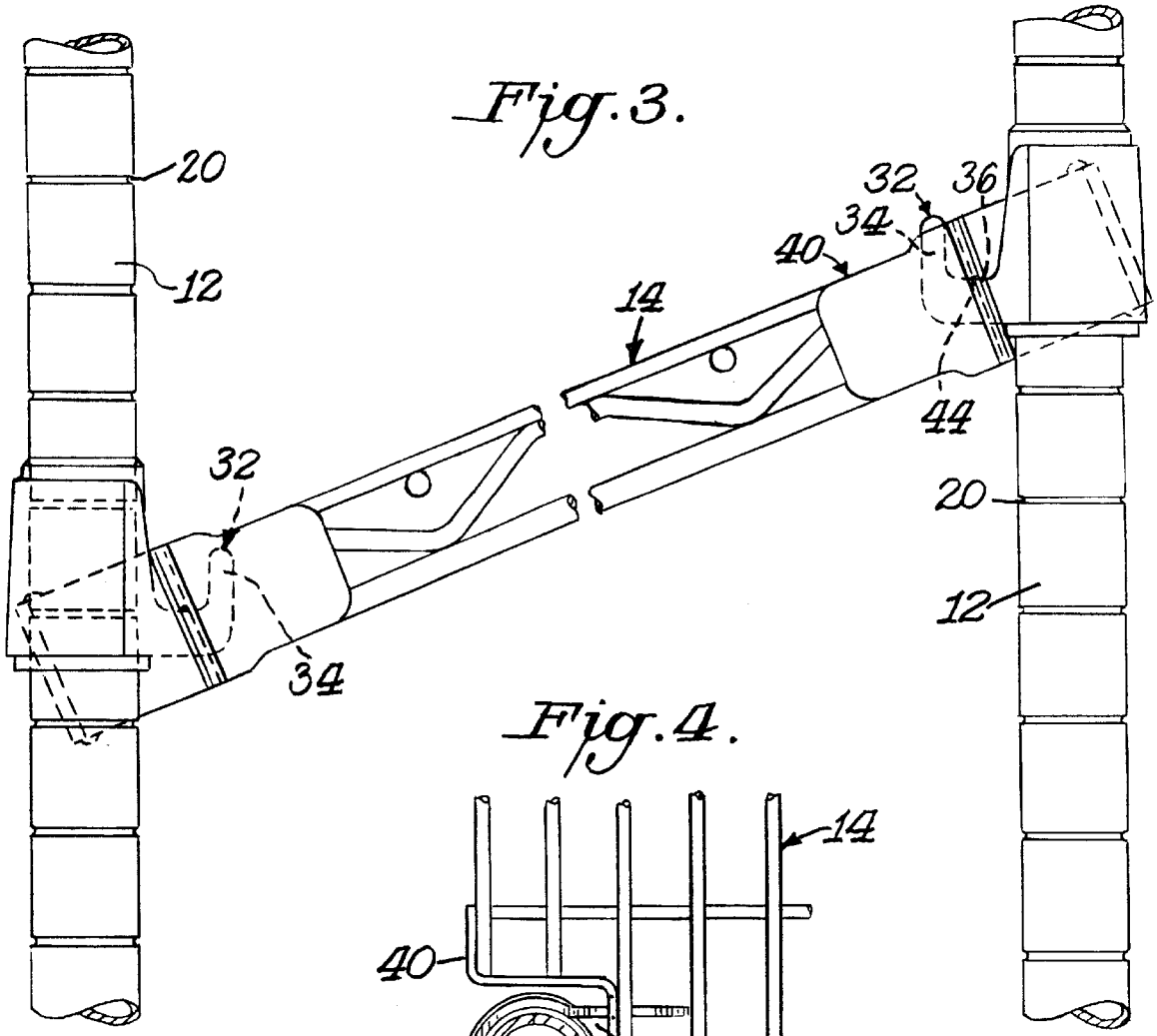
FIG. 3 is an enlarged side elevational view of the adjustable shelving assembly of the present invention, with shelving in an inclined position and portions thereof broken away to illustrate interior details of the connection between the posts and shelving.
Figure 4:
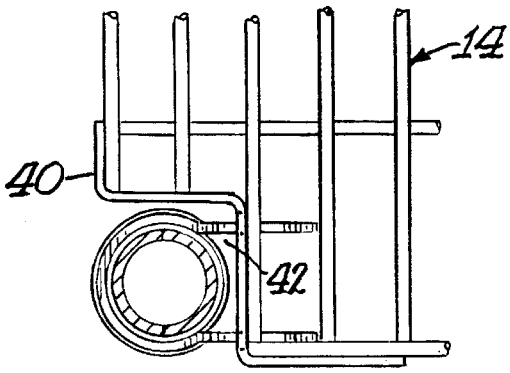
FIG. 4 is a fragmental top plan view of one of the corners of the shelving assembly taken along line 4—4 of FIG. 1.
Figure 8:
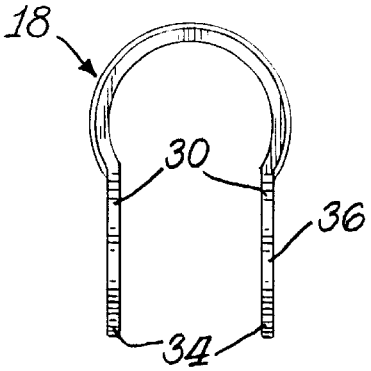
FIG. 8 is a top plan view of the shelf retaining collar shown in FIGS. 5–7.
Figure 5:
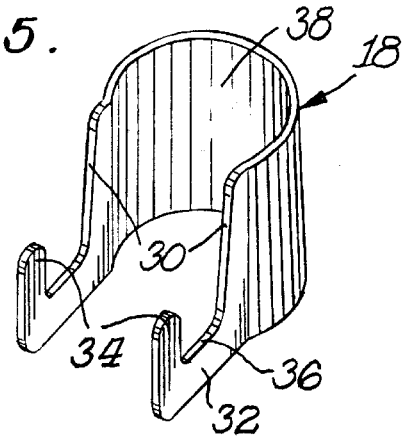
FIG. 5 is a perspective view illustrating one of the shelf retaining collars.
Figure 6:
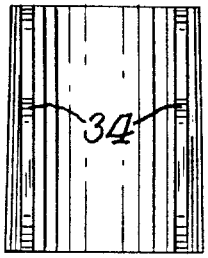
FIG. 6 is a front elevational view of the shelf retaining collar shown in FIG. 5.
Figure 7:
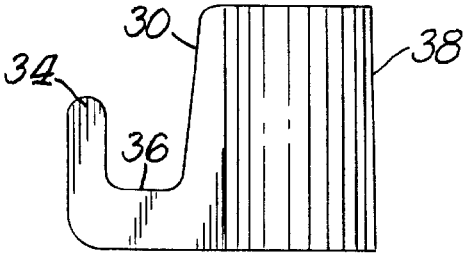
FIG. 7 is a side elevational view of the shelf retaining collar shown in FIGS. 5 and 6.

Referring in more particularly to the drawings, FIGS. 1–3 illustrate an adjustable shelving assembly 10, according to the present invention. In one of its forms, the assembly includes four corner support posts 12 and a plurality of shelves 14, 16 releasably mounted to the posts. Shelves 14 of the present invention are releasably mounted by separate and individual shelf retaining collars 18, one collar associated with each post for each shelf. Shelves 16 are releasably mounted to the posts in a conventional manner, as described more fully below.

The support posts 12 include a plurality of spaced apart horizontal annular grooves 20 that cooperate with the shelf retaining collars 18 to mount shelving 14. The exterior surface of each post is cylindrical, and support posts of this configuration are old in the art.

Shelves 16 also are old in art, and each shelf simply comprises a top surface 22 with an integral collar 24 at each corner thereof. The interior surface of each collar 24 is frusto-conical. A split sleeve 26 having a cylindrical interior surface and a frusto-conical exterior is utilized to mount each collar 24 to the support posts. Each split sleeve has an annular projection 28 on its interior surface that engages one of the grooves 20 in the support posts to thereby anchor the split sleeve to the support post. The four integral collars 24 of shelving 16 are fitted over and onto the split sleeves to thereby secure shelving 16 to the split sleeves and support posts. The mating frusto-conical surfaces of the collars 24 and the split sleeves 26 function to anchor the collar to the sleeve, and also to maintain the locking engagement between the interior annular projection 28 of the sleeve and a selected annular groove 20 of its associate support post.

Assembly and disassembly of shelving 16 is time consuming, particularly when an additional shelf is desired in the overall assembly of multiple shelves. However, with the shelving 14 and shelf retaining collars 18, it is not necessary to disassemble the shelves 16 when installing one or more additional shelves 14.

As shown best in FIGS. 5–8, each shelf retaining collar 18 has an open front 30 and a pair of upwardly extending hooks 32. These hooks include vertical legs 34 and horizontal support surfaces 36. Each shelf retaining collar also has a frusto-conical interior surface 38 for cooperation with split sleeves 26, as explained more fully below. Moreover, the shelf retaining collars 18 of the present invention may be fabricated of metal, such as stainless steel, for example.

Figure 9:
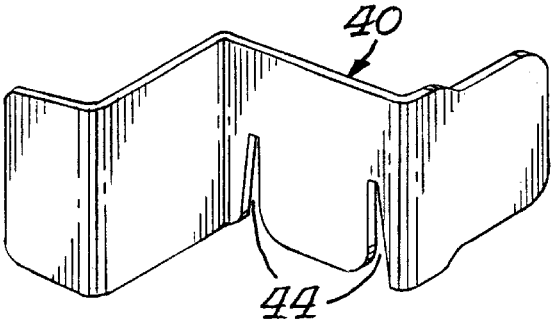
FIG. 9 is a perspective view of a corner shelf clip, according to the present invention.
Figure 10:
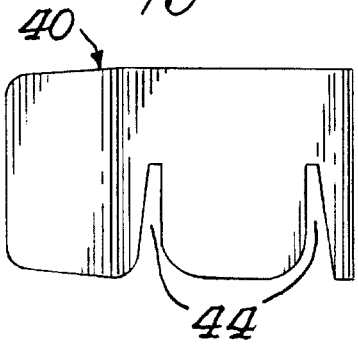
FIG. 10 is a front elevational view of the corner shelf clip shown in FIG. 9.

Each corner of shelf 14 is constructed and arranged to receive a corner shelf clip 40, shown best in FIGS. 9 and 10. Specifically, each corner of shelf 14 has a generally square recess 42 and the corner shelf clip 40 fits that recess. The shelf clips may be fabricated of metal, such as stainless steel. Moreover, each corner shelf clip may be secured in place by welding the clip to the shelving 14 at the recess 42. Each corner shelf clip 40 includes a pair of vertical slots 44 arranged to receive the hooks 32 of the shelf retaining collars 18 to thereby secure shelving 14 to the collars. This arrangement enables shelving 14 to articulate about a horizontal axis whereby such shelving may be horizontally and angularly disposed, as explained more fully below.

In one embodiment of the present invention, the adjustable shelving assembly 10 may include four corner support posts 12 with one conventional shelf 16 at the upper end of the posts and a similar shelf at the lower end of the posts. When additional shelving 14 is desired, a split sleeve 34 and a shelf retaining collar 18 are releasably connected to each post with the hooks 32 of the shelf retaining collar facing in an inward direction. Shelving 14 has the small corner recess 42 at each of its four corners with a shelf clip 40 secured thereto to accommodate engagement of the hooks 32 on each collar and the vertical slots 44 on each corner shelf clip.

Shelving 14 may be horizontally mounted or inclined, as shown best in FIGS. 1 and 3. Inclined shelving is the same as horizontal. Except that the collars 18 on the two front support posts 12 are positioned at a lower elevation with respect the collars on the rear posts. Also, shelving 14 has a greater width when used in an inclined position as compared to a horizontal shelf. The hooks 32 enable inclined positioning of the shelves 14, when desired, due to the articulation of the shelves about the hooks, as explained above. In either a horizontal or inclined position, the hooks of the shelf retaining collars engage the vertical slots 44 of the corner shelf clips 40, and these clips rest on the horizontal support surfaces 38 of the collars.

What is claimed is:

1. An adjustable shelving assembly comprising a plurality of vertically oriented support posts, at least one shelf retaining collar releasably secured to each post, each collar having an open front face constructed and arranged for placement of the collars around the vertical support posts, each shelf retaining collar having a frusto-conical interior surface, an interconnecting split sleeve between each collar and post, the split sleeve having an interior surface releasably connected to the support post and an exterior surface having a frusto-conical configuration complementary to the interior frusto-conical surface of the collar, a pair of upwardly extending shelf supporting hooks on each collar integral with the collar and extending outwardly parallel to one another from the open front face, and shelving interacting with the hooks of the collars to thereby connect the shelving to the support posts.

2. An adjustable shelving assembly as in claim 1 wherein the shelving includes a recess at each corner thereof, a shelf support clip secured at each recess, and wherein each clip has a pair of spaced apart vertical slots that engage the hooks on the shelf retaining collars.

* * * * *